US005997258A

United States Patent [19]

Sawyer, III et al.

[11] Patent Number: 5,997,258

[45] **Date of Patent: *Dec. 7, 1999**

[54] LOW NOISE REFRIGERANT COMPRESSOR HAVING CLOSED SHELLS AND SOUND ABSORBING SPACERS

[75] Inventors: Colon W. Sawyer, III, Bristol; Gordon A. Carter, Saltville; Gordon T. Boyd, Abington, all of Va.; Prakash N. Pandeya; Michael A. DiFlora, both of Bristol, Tenn.

[73] Assignee: Bristol Compressors, Inc., Bristol, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/650,208

[22] Filed: May 20, 1996

Related U.S. Application Data

[63] Continuation of application No. 08/251,062, May 31, 1994, abandoned.

[51] Int. Cl.[6] ..... G01K 11/00; F04B 39/00

[52] U.S. Cl. ..... 417/312; 417/902; 181/202

[58] Field of Search ..... 417/312, 363, 417/902, 415; 181/202, 294, 403; 415/119

[56] References Cited

U.S. PATENT DOCUMENTS

| | | | |
|---|---|---|---|
| 1,610,774 | 12/1926 | Hanson | 417/312 |
| 2,164,405 | 7/1939 | Hintze | 417/902 |
| 2,297,220 | 9/1942 | Hintze | 417/902 |
| 4,201,523 | 5/1980 | Olofsson | 417/312 |
| 4,265,965 | 5/1981 | Chancler | 181/294 |
| 4,347,043 | 8/1982 | Morris | 181/202 |
| 4,888,003 | 12/1989 | Johnson et al. | 417/312 |
| 4,982,812 | 1/1991 | Hwang | 181/202 |
| 5,080,130 | 1/1992 | Terwilliger et al. | 417/569 |
| 5,151,018 | 9/1992 | Clendenin | 417/312 |
| 5,272,285 | 12/1993 | Miller | 181/202 |
| 5,588,810 | 12/1996 | DiFlora et al. | 417/312 |

FOREIGN PATENT DOCUMENTS

| | | | |
|---|---|---|---|
| 2751469 | 5/1979 | Germany | 181/202 |
| 0280885 | 11/1988 | Japan | 417/902 |
| 404203380 | 7/1992 | Japan | 417/902 |

*Primary Examiner*—Ted Kim

[57] ABSTRACT

A compressor unit having a housing consisting of steel inner and outer shells, the shells being spaced apart from each other to provide an attenuation cell substantially occupying all of the space between the shells, a suction gas inlet and a discharge gas outlet extending through both of the shells and the cell and being isolated from the outer shell by sound absorbing means, and spacer material having sound absorbing properties positioned between the shells and maintaining the spacing therebetween, the spacing being, preferably, at least about 0.06 in. in width over at least a major portion of the cell.

7 Claims, 2 Drawing Sheets

LOW NOISE REFRIGERANT COMPRESSOR HAVING CLOSED SHELLS AND SOUND ABSORBING SPACERS

This application is file wrapper continuation of now abandoned Ser. No. 80/251,062 filed May. 31, 1994 now abandoned.

FIELD OF THE INVENTION

This invention concerns refrigerant compressor units and particularly concerns unique housing or shell construction that is especially adapted to markedly diminish the power of fundamental low frequency discharge pulsations and other compressor noise which typically is manifested in downstream structural vibrational noise or in compressor noise emanating directly from the compressor shell through vibrations thereof.

BACKGROUND OF THE INVENTION

In the case of refrigerant compressors used for air conditioning and heat pump applications, sound has become an increasingly important criteria for judging user acceptance. Accordingly, there is a demand for improved refrigerant compressors and refrigeration system which are quieter than those presently available, while sacrificing none of the advantages of existing compressors and refrigeration systems.

In this regard, the design and use of compressor unit shells must take into account many factors including the gas flow volumes and flow patterns within the shell and the space limitations of the shell with regard to accommodating various compressor components including the sizes, shapes and arrangement of discharge mufflers, suction plenums, discharge gas shock loops and the like. For example, while improved sound attenuation is usually achieved by increasing the muffler size and the number of baffles or the like contained therein, the adverse increased pressure drop across the muffler leads not only to reduced compressor efficiency, i.e., lowered Btu/Hr/Watts, but also to excessive strain on mechanical parts of the compressor such, e.g., as through irregular or fluttering discharge valve operation. Also, while the sizes of such components may aid in noise reduction, prior designs incorporating such have increased the weight of the unit to such an extent that the added shipping and handling costs as well as the additional expenses of material and manufacture have more than offset the advantages attained in the noise reduction.

DISCUSSION OF PRIOR ART

Further in regard to compressor shell design and configuration considerations, the particular objectionable operating noise frequencies encountered for a particular compressor construction will have a very significant influence on such considerations. For example, as discussed in U.S. Pat. No. 5,101,931, discharge pressure pulsation frequencies such as 1,000 Hz create noise which must be attenuated. Such noise and noise of higher frequencies are generated, for example, by the operation of the compressor valves, whether they be steel or other material, and conventional thin steel reed type valving such as shown in the aforesaid patent wherein metal to metal contact, often exacerbated by fluttering of the valve against the discharge porting seat, gives rise to high frequency harmonics of the fundamental low frequency pulsations. These objectionable harmonic vibrations are readily transmitted through various sound wave carrying components of the compressor including metal parts and compressor sump oil and are transmitted through or by the shell to the compressor exterior and ultimately to the human ear as objectionable sound waves.

Previous methods and devices for attenuating such compressor noise are exemplified by U.S. Pat. Nos. 4,264,282; 4,982,812; and 5,151,018 which employ sound deadening enclosures in which the compressor is contained. Such additional enclosures, of course, greatly add to the overall dimensions of the system, as well as diminish accessibility to the compressor, and cannot, therefore, be utilized in the restricted space of the refrigeration units which utilize applicants compressors.

A principal object of the invention therefore, is to reduce compressor noise by modifying the shell construction of compressor units whereby the level of noise reduction achieved markedly exceeds any disadvantages due, e.g., to increased costs in manufacture and handling.

SUMMARY OF THE INVENTION

The above and further objects hereinafter becoming evident have been attained in accordance with the present invention which in its broad sense is defined as a compressor unit comprising housing means, compressor means mounted in said housing means, said housing means consisting of a steel inner shell and an outer shell of steel or other strong material, said shells being spaced apart over at least about 75%, preferably at least about 95% of the total adjacent wall area to provide attenuation cell means substantially occupying all of the space between said shells, suction gas inlet and discharge gas outlet means extending through both of said shells and cell means, and spacer means secured between said shells and maintaining the spacing therebetween, preferably of at least about 0.06 in., and most preferably from about 0.1 to about 0.5 in. over at least a major portion of said cell means.

In certain preferred embodiments:

(a) the spacer means comprises a plurality of elastomeric cushions;

(b) the spacer means comprises principally an in-situ foamed elastomeric or rigid sound deadening, cushioning, polymeric material occupying substantially all of said cell means;

(c) said foamed material comprises one or a mixture of polymers selected from polyurethane, urethane-modified isocyanurate, polystyrene, polyvinyl chloride, polyethylene, or polypropylene;

(d) the wall thickness of each said shell being from about 0.05 to about 0.2 in., most preferably from about 0.1 to about 0.12 in., and the ratio of the total volume in $cm^3$ of said cell means to the volume in $cm^3$ of discharge gas/second at maximum compressor load, being from about 0.19 to about 1.43; and (e) the attenuation cell means is substantially filled with comminuted inorganic or organic filler material such as sand, clay or cryogenically ground linear or cross-linked polymer.

BRIEF DESCRIPTION OF THE DRAWINGS

The invention will be further understood from the following description and drawing of preferred embodiments, wherein.

DETAILED DESCRIPTION OF THE DRAWING

Figure 1:
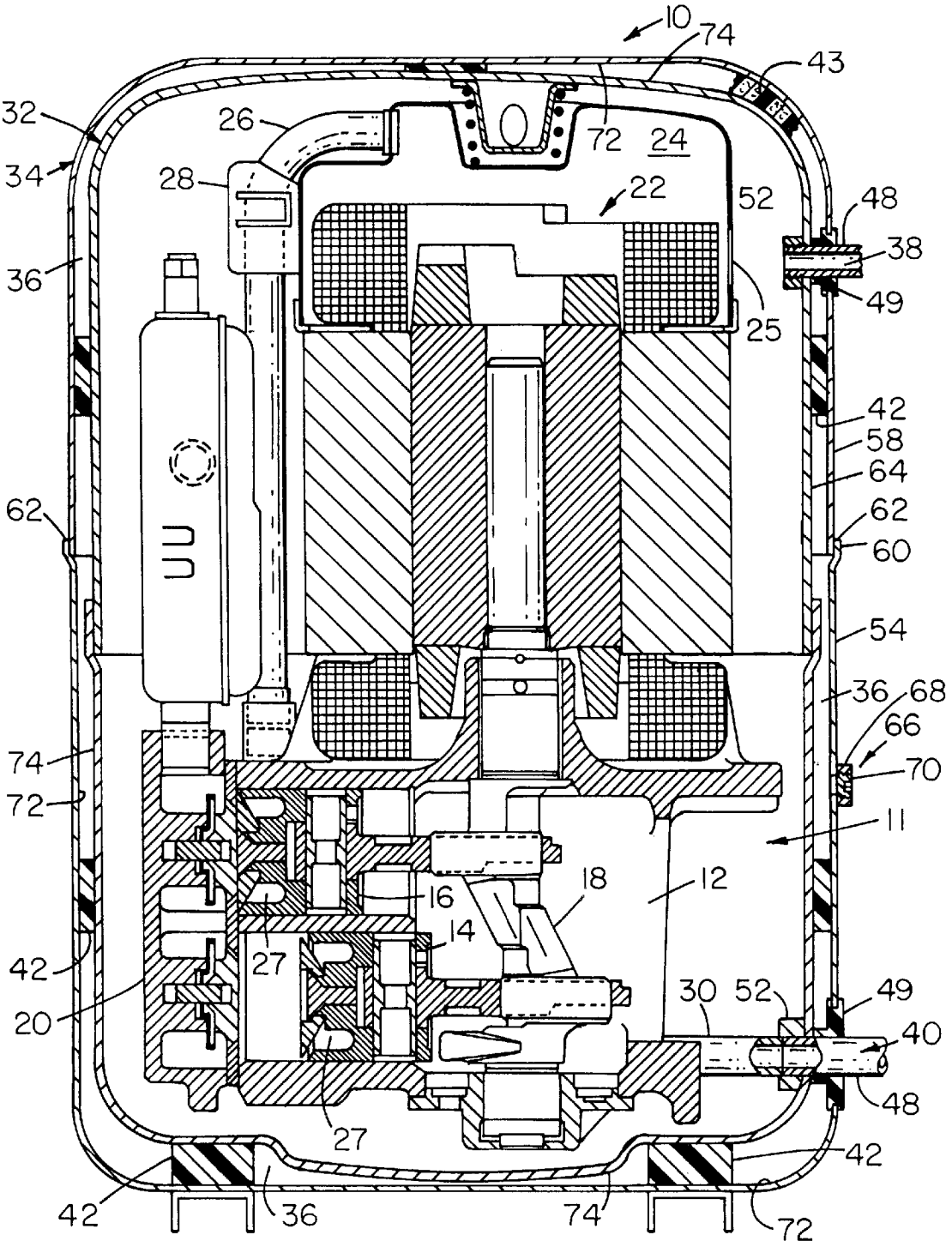
FIG. 1 is a longitudinal cross-section of a refrigerant gas compressor unit showing the present double shell housing for a compressor.
Figure 2:
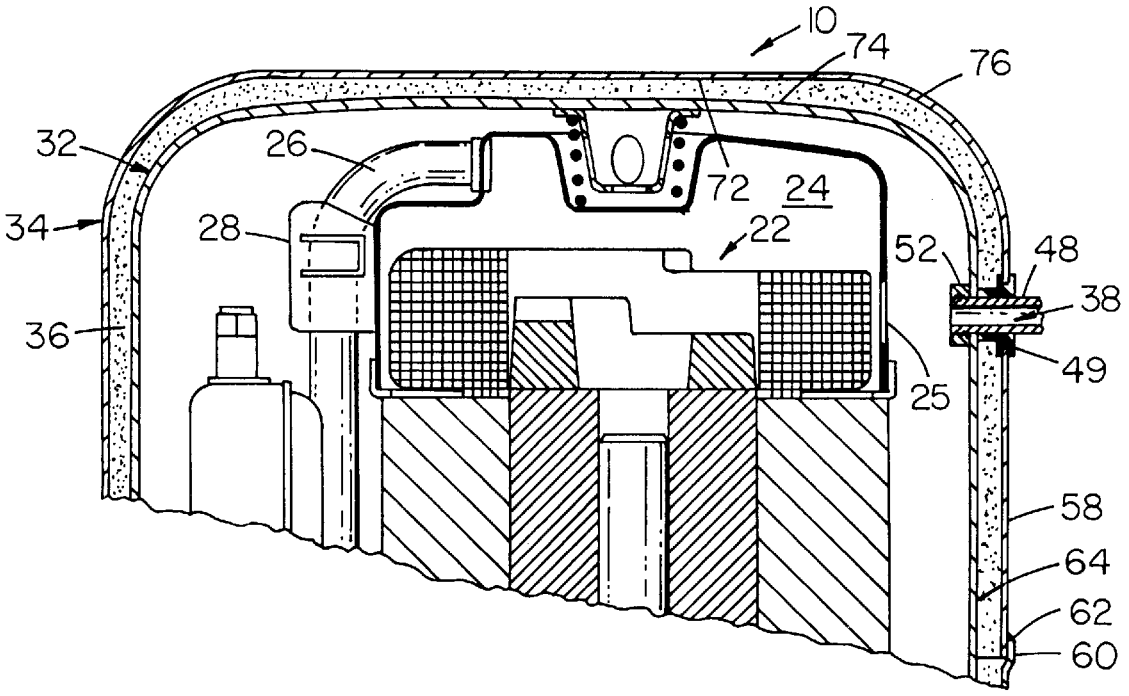
FIG. 2 is a view as in FIG. 1 of a portion of the unit showing the use of a comminuted material spacer means.

Referring to the drawing, the compressor unit generally designated 10 comprises a compressor having cylinder block 12, pistons 14, 16, crankshaft 18, head 20, electric motor 22, suction plenum 24 having inlet aperture 25 through the side wall thereof, suction conduit 26 communicating with plenum 24 and the compressor suction inlets 27 in the tops of the pistons, suction muffler 28, and discharge shock loop 30. Such a compressor is shown, for example, in U.S. Pat. Nos. 5,238,370; 5,123,816; 5,080,130, the disclosures of which are hereby incorporated herein by reference. The present invention is, however, applicable to a wide variety of compressor types and configurations.

The present unique double shell housing arrangement for the compressor, with reference to the claims hereof, consists of a steel inner shell 32 and an outer shell 34 of steel or other strong material such as polyamide, polycarbonate, cellulose acetate-butyrate, or the like, said shells being spaced apart over at least about 75%, preferably at least about 95% of the total adjacent wall area of said shells, i.e., the total area of the outside of shell 32 and the inside of shell 34, to provide attenuation cell means 36 substantially occupying all of the space between said shells, suction gas inlet 38 and discharge gas outlet means 40 extending through both of said shells and cell means, and spacer means 42 secured between said shells and maintaining a spacing therebetween over, e.g., said at least about 75% of said total adjacent wall area, said spacing preferably being at least about 0.06 in., most preferably from about 0.1 to about 0.5 in. in width. Preferably the shells are both steel and the wall thickness of each is from about 0.05 to about 0.2 inch.

The inner and outer shells are shown as substantially the same in shape, however, significant differences in their shapes may be desireable, e.g., from a manufacturing or assembly standpoint. The spacer means 42 as individual elements are adequately provided by a number of strategically positioned cushions of rubber or the like secured between the inner and outer shells. The spacer means may also be provided as a continuous, in-situ foamed cushion as described below.

The suction inlet and discharge outlet means each may comprise the structure shown for 38, which consists of a tube 48 inserted through an elastomeric flexible grommet 49 affixed in said outer shell wall and securely tightened in a nut 52 welded to said inner shell wall.

In making the assembly as shown in FIG. 1, the compressor generally designated 11 is mounted in typical manner in shell 32 which is then placed within the lower half 54 of the outer shell and supported therein in proper position by a suitable number of positioning blocks such as 42, preferably previously adhesively secured to 54. The upper half 58 of the outer shell is then placed in position within the girth rim 60 of the lower half and welded, brazed or otherwise, e.g., by pop rivets, affixed thereto as at 62. Prior to said placement of 58, blocks such as 42 may be secured in desirable locations on the outer surface of the upper half 64 of the inner shell and/or on the inner surface of upper half 58. The suction tube 38 and discharge 40 tubes are then inserted through their respective grommets and threaded into said nuts 52.

For certain applications it is preferred, at this point, to inject, through one or more bungs 66, in known manner, the reactive components for producing in-situ, elastomeric or rigid polymeric material wherein said components substantially permeate, foam and cure by heat or aging within the cell means 36 to encapsulate the cushioning or positioning blocks 42 to provide an essentially monolithic sound deadening spacer means, a portion of which is shown at 43. Such technology is well developed in the art. For example, during the formation of polyurethane from an isocyanate reactant and a polyol, $CO_2$ is released and provides the foaming agent. Other foaming agent systems such as $NaHCO_3$/HAc can be introduced into the attenuation cell means along with the reactive monomers or reactants, or with melted linear polymer to produce the foamed spacer in-situ. The bungs 66 preferably comprise a nut 68 welded to the inner or outer surface of the outer shell, and an Allen screw 70 or the like for threading therein and sealing the bung aperture. These bungs also provide access to the attenuation cell means for sand or other of the aforementioned filler material.

It is preferred that the spacing of the inner and outer shells be substantially uniform along at least the major portion of their adjacent surfaces, however, such is not essential to realizing marked improvements in noise attenuation.

In actual noise reduction evaluation tests conducted as comparisons of the present double shell invention with a standard single shell, both compressors were otherwise identical in all respects. The results of the tests show that the present double housing construction effects a sound reduction of from about 5.8 dBA to about 11 dBA, the greater sound reduction being effected by substantially filling the attenuation cell means with sand or other particulate material.

The invention has been described in detail with particular reference to preferred embodiments thereof, but it will be understood that variations and modifications will be effected with the spirit and scope of the invention.

We claim:

1. A compressor unit having housing means consisting of a closed steel inner shell and a closed outer shell of strong, substantially rigid material, a compressor comprising a cylinder block, one or more cylinders and associated pistons, cylinder head, suction and discharge valve structure, and an electric motor mounted on and within said inner shell and isolated from said outer shell by said inner shell, said shells each being formed of continuous wall means which are spaced apart from each other over their entire adjacent wall surface areas to provide an attenuation cell means occupying substantially all of the space between said shells, suction gas inlet means and discharge gas outlet means extending through both of said shells and said cell means, and sound absorbing spacer means secured between said shells and maintaining the spacing therebetween for providing said cell means, and wherein all structural elements which communicate from outside of said outer shell to within said inner shell are mounted on said unit by sound absorbing means.

2. The unit of claim 1 wherein said spacing is at least about 0.06 in. in width over at least a major portion of said wall means, and wherein said spacer means comprises a plurality of elastomeric cushions spaced apart throughout said cell means.

3. The unit of claim 2 wherein said foamed material comprises one or a mixture of polymeric material selected from polyurethane, urethane-modified isocyanurate, polystyrene, polyvinyl chloride, polyethylene, or polypropylene.

4. The unit of claim 1 wherein said spacer means comprises principally an in-situ foamed elastomeric or rigid sound deadening, cushioning, polymeric material occupying at least a major portion of said cell means.

5. The unit of claim 1 wherein a wall thickness of each said shell is from about 0.05 to about 0.2 in., and a ratio of the total volume in $cm^3$ of said cell means to a volume in $cm^3$ of discharge gas/second at maximum compressor load, is from about 0.19 to about 1.43.

6. The unit of claim 1 wherein said attenuation cell means is substantially filled with comminuted inorganic or organic material.

7. The unit of claim 1 wherein said outer shell is also of steel and there are no areas of metal-to-metal contact between said shells, which areas would readily transmit noise from within said inner shell to said outer shell.

* * * * *